US007302388B2

(12) United States Patent
Zhang et al.

(10) Patent No.: US 7,302,388 B2
(45) Date of Patent: Nov. 27, 2007

(54) METHOD AND APPARATUS FOR DETECTING VOICE ACTIVITY

(75) Inventors: Song Zhang, Kanata (CA); Eric Verreault, Ottawa (CA)

(73) Assignee: Ciena Corporation, Linthicum, MD (US)

( * ) Notice: Subject to any disclaimer, the term of this patent is extended or adjusted under 35 U.S.C. 154(b) by 759 days.

(21) Appl. No.: 10/781,352

(22) Filed: Feb. 17, 2004

(65) Prior Publication Data

US 2005/0038651 A1 Feb. 17, 2005

(30) Foreign Application Priority Data

Feb. 17, 2003 (CA) ..... 2420129

(51) Int. Cl.
*G10L 11/02* (2006.01)

(52) U.S. Cl. ..... 704/233; 704/210; 704/215; 704/236

(58) Field of Classification Search ..... None
See application file for complete search history.

(56) References Cited

U.S. PATENT DOCUMENTS 4,696,039 A 9/1987 Doddington
5,579,432 A 11/1996 Wigren
6,349,278 B1 2/2002 Krasny et al.
2002/0120440 A1 8/2002 Zhang
2002/0165713 A1 11/2002 Skoglund et al.
2004/0064314 A1 * 4/2004 Aubert et al. ..... 704/233

OTHER PUBLICATIONS

International Search Report of PCT/US04/04490.
Written Opinion of PCT/US04/04490.
Sohn, Jongseo et al., A Statistical Model-Based Voice Activity Detection, IEEE Signal Processing Letters, vol. 6, No. 1, Jan. 1999, pp. 1-3.

* cited by examiner

*Primary Examiner*—Donald L. Storm
(74) *Attorney, Agent, or Firm*—Merek, Blackmon & Voorhees, LLC

(57) ABSTRACT

Method and apparatus detect voice activity for spectrum or power efficiency purposes. The method determines and tracks the instant, minimum and maximum power levels of the input signal. The method selects a first range of signals to be considered as noise, and a second range of signals to be considered as voice. The method uses the selected voice, noise and power levels to calculate a log likelihood ratio (LLR). The method uses the LLR to determine a threshold, then uses the threshold for differentiating between noise and voice.

10 Claims, 7 Drawing Sheets

METHOD AND APPARATUS FOR DETECTING VOICE ACTIVITY

CROSS-REFERENCES TO RELATED APPLICATIONS

This application claims priority from Canadian Patent Application No. 2,420,129 filed Feb. 17, 2003

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates generally to signal processing and specifically to a method for processing a signal for detecting voice activity.

Voice activity detection (VAD) techniques have been widely used in digital voice communications to decide when to enable reduction of a voice data rate to achieve either spectral-efficient voice transmission or power-efficient voice transmission. Such savings are particularly beneficial for wireless and other devices where spectrum and power limitations are an important factor. An essential part of VAD algorithms is to effectively distinguish a voice signal from a background noise signal, where multiple aspects of signal characteristics such as energy level, spectral contents, periodicity, stationary, and the like have to be explored.

Traditional VAD algorithms tend to use heuristic approaches to apply a limited subset of the characteristics to detect voice presence. In practice, it is difficult to achieve a high voice detection rate and low false detection rate due to the heuristic nature of these techniques.

To address the performance issue of heuristic algorithms, more sophisticated algorithms have been developed to simultaneously monitor multiple signal characteristics and try to make a detection decision based on joint metrics. These algorithms demonstrate good performance, but often lead to complicated implementations or, inevitably, become an integrated component of a specific voice encoder algorithm.

Lately, a statistical model based VAD algorithm has been studied and yields good performance and a simple mathematical framework. This algorithm is described in detail in "A Statistical Model-Based Voice Activity Detection", Jongseo Sohn, Nam Soo Kim, and Wonyong Sung, IEEE Signal Processing Letters, Vol. 6, No. 1, January 1999. The challenge, however, lies in applying this new algorithm to effectively distinguish voice and noise signals, as assumptions or prior knowledge of the SNR is required.

Accordingly, it is an object of the present invention to obviate or mitigate at least some of the abovementioned disadvantages.

BRIEF SUMMARY OF THE INVENTION

In accordance with an aspect of the present invention, there is provided a method for voice activity detection on an input signal using a log likelihood ratio (LLR), comprising the steps of: determining and tracking the signal's instant, minimum and maximum power levels; selecting a first predefined range of signals to be considered as noise; selecting a second predefined range of signals to be considered as voice; using the voice, noise and power signals for calculating the LLR; using the LLR for determining a threshold; and using the threshold for differentiating between noise and voice.

BRIEF DESCRIPTION OF THE DRAWINGS

An embodiment of the present invention will now be described by way example only with reference to the following drawings in which.

DETAILED DESCRIPTION OF THE INVENTION

Figure 1:
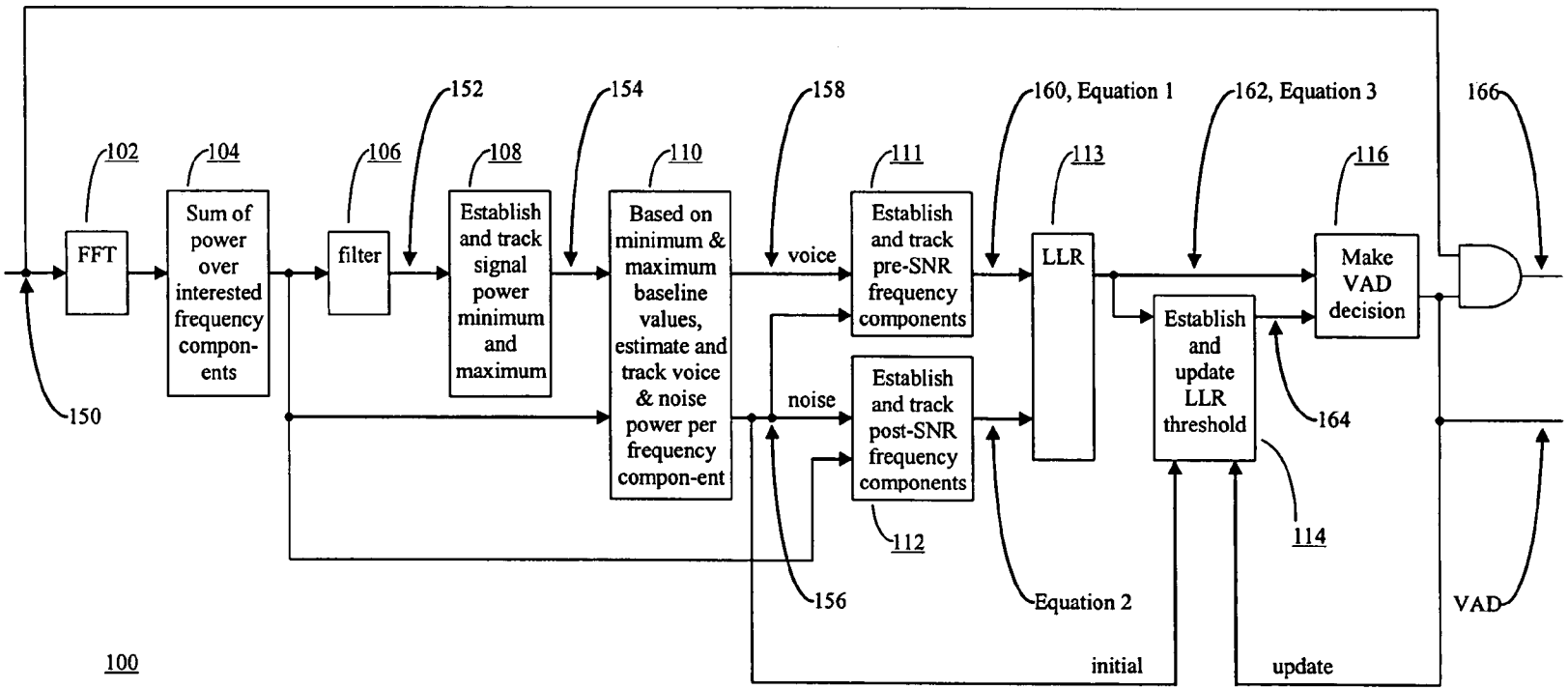
FIG. 1 is a flow diagram illustrating the operation of a VAD algorithm according to an embodiment of the present invention.

For convenience, like numerals in the description refer to like structures in the drawings. The following describes a robust statistical model-based VAD algorithm. The algorithm does not rely on any presumptions of voice and noise statistical characters and can quickly train itself to effectively detect voice signal with good performance. Further, it works as a stand-alone module and is independent of the type of voice encoders implemented.

The method described herein provides several advantages, including the use of a statistical model based approach with proven performance and simplicity, and self-training and adapting without reliance on any presumptions of voice and noise statistical characters. The method provides an adaptive detection threshold that makes the algorithm work in a wide range of signal-to-noise ratio (SNR) scenarios, particularly low SNR applications with a low false detection rate, and a generic stand-alone structure that can work with different voice encoders.

The underlying mathematical framework for the algorithm is the log likelihood ratio (LLR) of the event when there is noise only, and of the event when there are both voice and noise. These events can be mathematically formulated as follows.

A frame of a received signal is defined as y(t), where y(t)=x(t)+n(t), and where x(t) is a voice signal and n(t) is a noise signal. A corresponding pre-selected set of complex frequency components of y(t) is defined as Y.

Further, two events are defined as $H_0$ and $H_1$. $H_0$ is the event where speech is absent and thus Y=N, where N is a corresponding pre-selected set of complex frequency components of the noise signal n(t). $H_1$ is the event where speech is present and thus Y=X+N, where X is a corresponding pre-selected set of complex frequency components of the voice signal x(t).

It is sufficiently accurate to model Y as a jointly Gaussian distributed random vector with each individual component as an independent complex Gaussian variable, and Y's probability density function (PDF) conditioned on $H_0$ and $H_1$ can be expressed as:

$$p(Y \mid H_0) = \prod_{k=0}^{L-1} \frac{1}{\pi\lambda_N(k)} \exp\left(-\frac{|Y_k|^2}{\lambda_N(k)}\right)$$

$$p(Y \mid H_1) = \prod_{k=0}^{L-1} \frac{1}{\pi[\lambda_X(k)+\lambda_N(k)]} \exp\left(-\frac{|Y_k|^2}{[\lambda_X(k)+\lambda_N(k)]}\right)$$

where $\lambda_X(k)$ and $\lambda_N(k)$ are the variances of the voice complex frequency component $X_k$ and the noise complex frequency component $N_k$, respectively.

The log likelihood ratio (LLR) of the $k^{th}$ frequency component is defined as:

$$\log(\Lambda_k) = \log\left(\frac{p(Y_k \mid H_1)}{p(Y_k \mid H_0)}\right) = \left(\frac{\gamma_k \cdot \xi_k}{1+\xi_k}\right) - \log(1+\xi_k)$$

where, $\xi_k$ and $\gamma_k$ are the a priori signal-to-noise ratio (pri-SNR) and a posteriori signal-to-noise ratios (post-SNR) respectively, and are defined by:

$$\xi_k = \frac{\lambda_X(k)}{\lambda_N(k)} \qquad \text{Equation 1}$$

$$\gamma_k = \frac{|Y_k|^2}{\lambda_N(k)} \qquad \text{Equation 2}$$

Then, the LLR of vector Y given $H_0$ and $H_1$, which is what a VAD decision may be based on, can expressed as:

$$\log(\Lambda) = \sum_k \log(\Lambda_k) = \sum_k \log\left(\frac{p(Y_k \mid H_1)}{p(Y_k \mid H_0)}\right) = \sum_k \left(\left(\frac{\gamma_k \cdot \xi_k}{1+\xi_k}\right) - \log(1+\xi_k)\right) \qquad \text{Equation 3}$$

A LLR threshold can be developed based on SNR levels, and can be used to make a decision as to whether the voice signal is present or not.

Referring to FIG. 1, a flow chart illustrating the operation of a VAD algorithm in accordance with an embodiment of the invention is shown generally by numeral 100. In step 102, over a given period of time, an inbound signal is transformed from the time domain to the frequency domain by a Fast Fourier Transform, and the signal power on each frequency component is calculated. In step 104, the sum of the signal power over a pre-selected frequency range is calculated. In step 106, the sum of the signal power is passed through a first order Infinite Impulse Response (IIR) averaging filter for extracting frame averaged dynamics of the signal power. In step 108, the envelope of the power dynamics is extracted and tracked to build a minimum and maximum power level. In step 110, using the minimum and maximum power level as a reference, two power ranges are established: a noise power range and a voice power range. For each frame whose power falls into either of the two ranges, its per frequency power components are used to calculate the frame averaged per frequency noise power or voice power respectively. In step 111, noise and voice powers are averaged once per frequency over multiple frames, and they are used to calculate the a priori signal-to-noise ratio (pri-SNR) per frequency in accordance with Equation 1. In step 112, a per frequency posteriori SNR (post-SNR) is calculated on per frame basis in accordance with Equation 2. In step 113, the post-SNR and the pri-SNR are used to calculate the per frame LLR value in accordance according with Equation 3. In step 114, a LLR threshold is determined for making a VAD decision. In step 116, as the LLR threshold becomes available, the algorithm enters into a normal operation mode, where each frame's LLR value is calculated in accordance with Equation 3. The VAD decision for each frame is made by comparing the frame LLR value against established noise LLR threshold. In the meantime, the quantities established in steps 106, 108, 110, 111, 112 and 114 are updated on a frame by frame basis.

Figure 2:
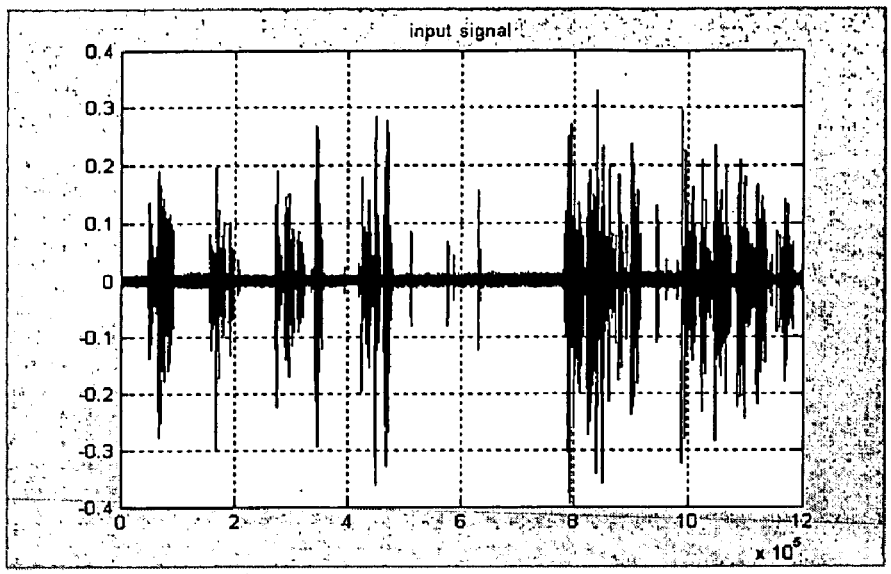
FIG. 2 is a graph illustrating a sample noise corrupted voice signal.

One way of implementing the operation of the VAD algorithm illustrated in FIG. 1 is described in detail as follows. Referring to FIG. 2, a sample input signal is illustrated. (See also line 150 in FIG. 1.) The input signal represents a combination of voice and noise signals of varying amplitude over a period of time. Each inbound 5 ms signal frame comprises 40 samples. In step 102, for each frame, a 32 or 64-point FFT is performed. If a 32-point FFT is performed, the 40-sample frame is truncated to 32 samples. If a 64-point FFT is performed, the 40-sample frame is zero padded. It will be appreciated by a person skilled in the art that the inbound signal frame size and FFT size can vary in accordance with the implementation.

Figure 3:
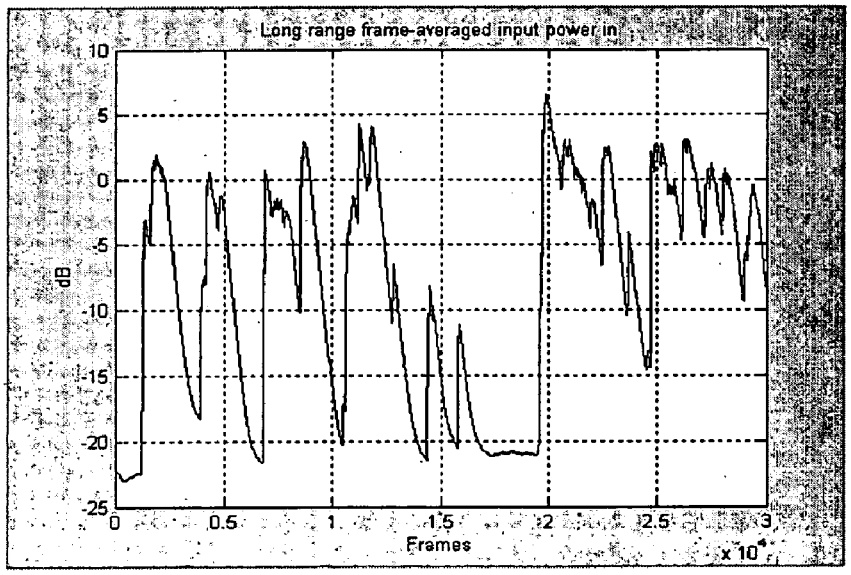
FIG. 3 is a graph illustrating signal dynamics of a sample noise corrupted voice signal.

In step 104, the sum of signal power over the pre-selected frequency set is calculated from the FFT output. Typically, the frequency set is selected such that it sufficiently covers the voice signal's power. In step 106, the sum of signal power is filtered through a first-order IIR averaging filter for extracting the frame-averaged signal power dynamics. The IIR averaging filter's forgetting factor is selected such that signal power's peaks and valleys are maintained. Referring to FIG. 3, a sample output signal of the IIR averaging filter is shown. (See also line 152 in FIG. 1.) The output signal represents the power dynamic of the input signal over a number of frames The next step 108 is to determine minimum and maximum power levels and to track these power levels as they progress. One way of determining the initial minimum and maximum signal levels is described as follows. Since the signal's power dynamic is available from the output of the IIR averaging filter (step 106), a simple absolute level detector may be used for establishing the signal power's initial minimum and maximum level. Accordingly, the initial minimum and maximum power levels are the same.

Figure 4:
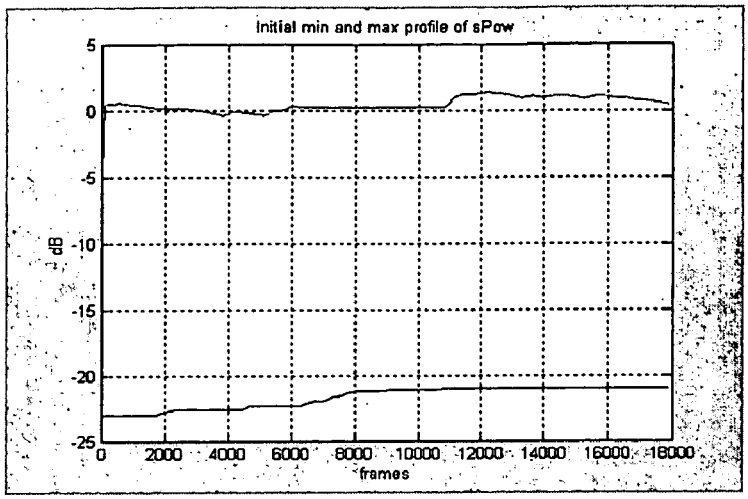
FIG. 4 is a graph illustrating the establishment and tracking of minimum and maximum signal levels.

Once the initial minimum and maximum power levels have been determined, they may be tracked, or updated, using a slow first-order averaging filter to follow the signal's dynamic change. ("Slow" in this context means a time constant of seconds, relative to typical gaps and pauses in voice conversation.) Accordingly, the minimum and maximum power levels will begin to diverge. Thus, after several frames, the minimum and maximum power levels will reflect an accurate measure of the actual minimum and maximum values of the input signal power. In one example, the minimum and maximum power levels are not considered to be sufficiently accurate until the gap between them has surpassed an initial signal level gap. In this particular example, the initial signal level gap is 12 dB, but may differ as will be appreciated by one of ordinary skill in the art. Referring to FIG. 4, a sample output of the minimum and maximum signal levels is shown. (See also line 154 in FIG. 1.)

Further, in order to provide a high level of stability for inhibiting the power level gap from collapsing, the slow first-order averaging filter for tracking the minimum power level may be designed such that it is quicker to adapt to a downward change than an upward change. Similarly, the slow first-order averaging filter for tracking the maximum power level may be designed such that it is quicker to adapt to an upward change than a downward change. In the event that the power level gap does collapse, the system may be reset to establish a valid minimum/maximum baseline.

Figure 5:
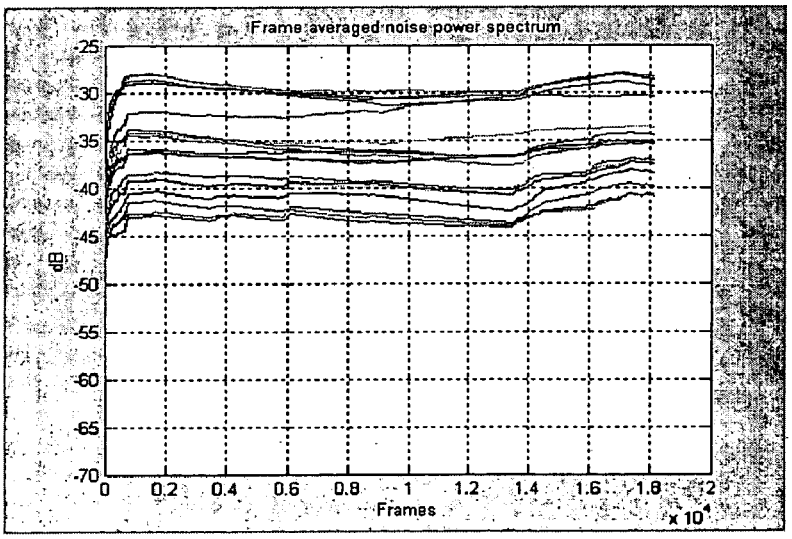
FIG. 5 is a graph illustrating the establishment of a noise power profile.
Figure 6:
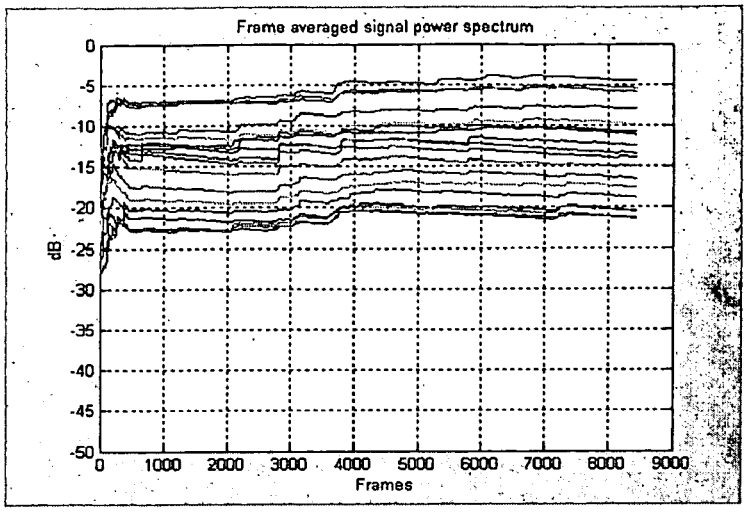
FIG. 6 is a graph illustrating the establishment of a voice power profile.

In step 110, using the slow-adapting minimum and maximum power levels as a baseline, a range of signals are defined as noise and voice respectively. A noise power level threshold is set at minimum power level +x dB, and a voice power level threshold is set at maximum power −y dB. For the purpose of this step, any signals whose power falls below the noise power level threshold are considered noise. A sample noise power profile against the pre-selected frequency components is illustrated in FIG. 5. (See also line 156 in FIG. 1.) Similarly, any signals whose power falls above the voice power level threshold are considered voice. A sample voice power profile against the frequency components is illustrated in FIG. 6. (See also line 158 in FIG. 1.) A first-order IIR averaging filter may be used to track the slowly-changing noise power and voice power. It should be noted that the margin values, x and y, used to set the noise and voice threshold need not be the same value.

Figure 7:
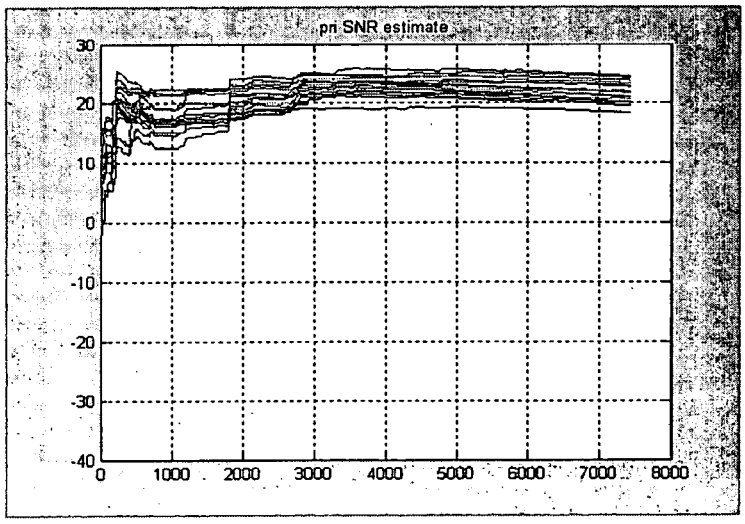
FIG. 7 is a graph illustrating the establishment and tracking of a pri-SNR profile.

In step 111, once the noise power and voice power profiles have been established, a pri-SNR profile against the frequency components of the signal is calculated in accordance with Equation 1. The pri-SNR profile is subsequently tracked on a frame-by-frame basis using a first-order IIR averaging filter having the noise and voice power profiles as its input. Referring to FIG. 7, a sample pri-SNR profile is shown. (See also line 160 in FIG. 1.)

In step 112, in parallel with the pri-SNR calculation, as the noise power profile against frequency components becomes available, the post-SNR profile is obtained by dividing each frequency component's instant power against the corresponding noise power, in accordance with Equation 2. In step 113, as both the pri-SNR and post-SNR profiles become available for each signal frame, the LLR value can be calculated in accordance with Equation 3 on a frame-by-frame basis.

In step 114, the LLR threshold is established by averaging the LLR values corresponding to the signal frames whose power falls within the noise level range established in step 110. The LLR threshold may be subsequently tracked using a first-order IIR averaging filter. As an alternative, once the LLR threshold has been established and VAD decisions are occurring on a frame-by-frame basis, subsequent LLR threshold updating and tracking can be achieved by using the noise LLR values when the VAD output indicates the frame is noise.

Figure 8:
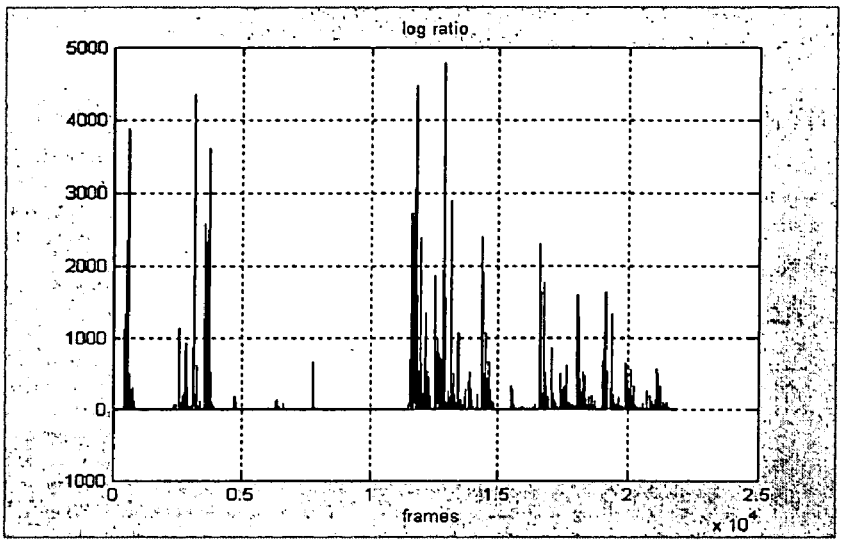
FIG. 8 is a graph illustrating the LLR distribution over time.
Figure 9:
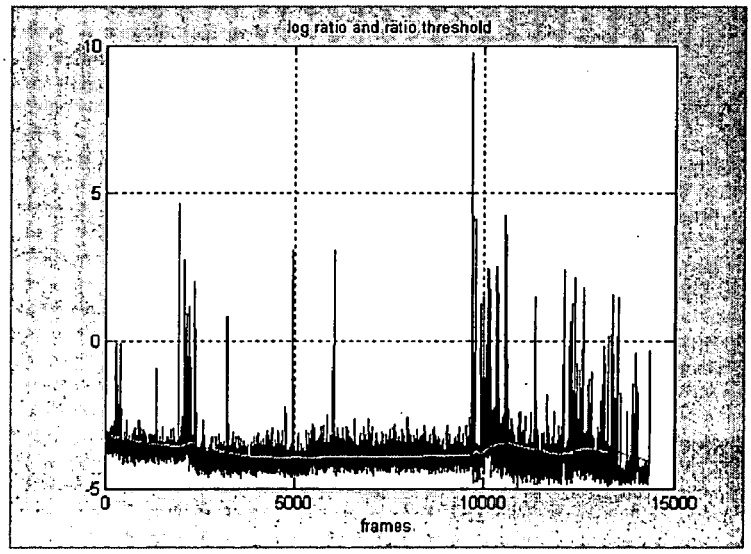
FIG. 9 is an enlarged view of a portion of the graph in FIG. 8.

The result is shown in FIGS. 8 and 9. Referring to FIG. 8, a sample of LLR distribution over time is illustrated. (See also line 162 in FIG. 1.) Referring to FIG. 9, a smaller scale portion of the LLR distribution in FIG. 8 is illustrated, with the LLR threshold superimposed. (See also line 164 in FIG. 1.) According to the LLR calculations, results at zero and below are likely to be noise. The further below zero the result, the more likely it is to be noise. It should be noted that although some frames may have been considered as noise in the step 110, this determination is not reliable enough for VAD. This fact is illustrated in FIG. 9, where some of the LLR values for frames that would have been categorized as noise in step 110 are well above zero.

Figure 10:
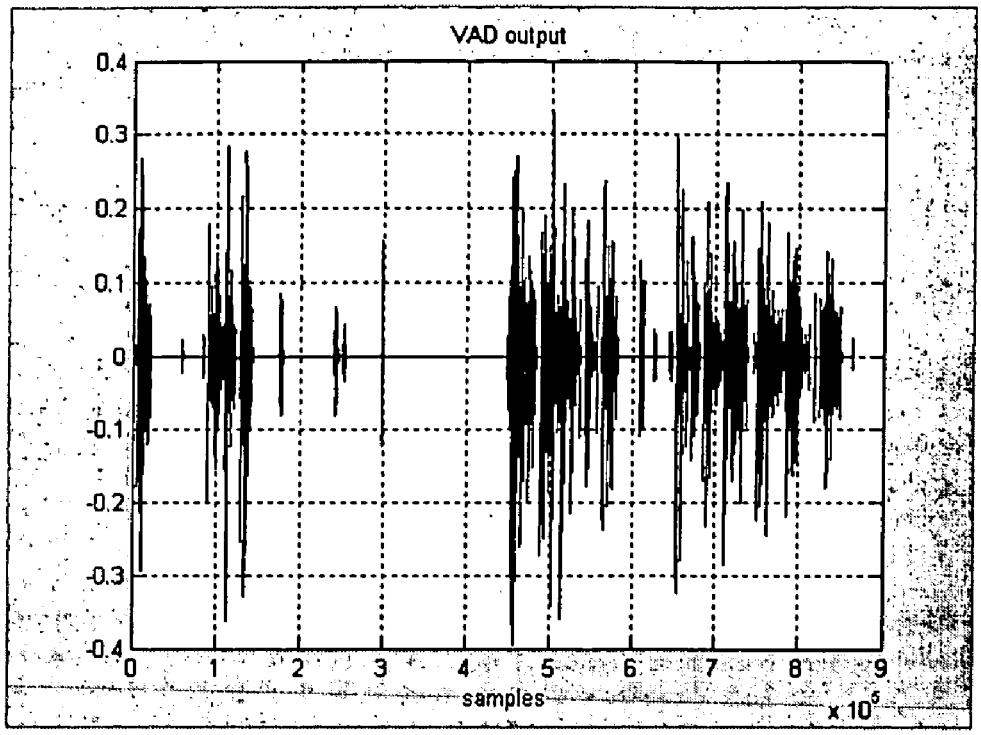
FIG. 10 is a graph illustrating a noise suppressed voice signal.

In step 116, once the LLR threshold has been established, silence detection is initiated on a frame-by-frame basis. The number of LLR values required before the LLR threshold is considered to be established is implementation dependent. Typically, the greater the number of LLR values required before considering the threshold established, the more reliable the initial threshold. However, more LLR values requires more frames, which increases the response time. Accordingly, each implementation may differ, depending on the requirements and designs for the system in which it is to be implemented. Once the threshold has been established, a frame is considered as silent if its LLR value is below LLR threshold+m dB, where m dB is a predefined margin. Typically, LLR threshold+m dB is below zero with sufficient margin. Further, silence suppression is not triggered unless there are h number of consecutive silence frames, also referred to as a hang-over time. A typical hang over time is 100 ms, although this may vary as will be appreciated by a person skilled in the art. Referring to FIG. 10, a noise-removed voice signal in accordance with the present embodiment is illustrated. (See also line 166 in FIG. 1.)

It should also be noted that the forgetting factors used in every first-order IIR averaging filter can be individually tuned to achieve optimal overall performance, as will be appreciated by a person of ordinary skill in the art.

Figure 11:
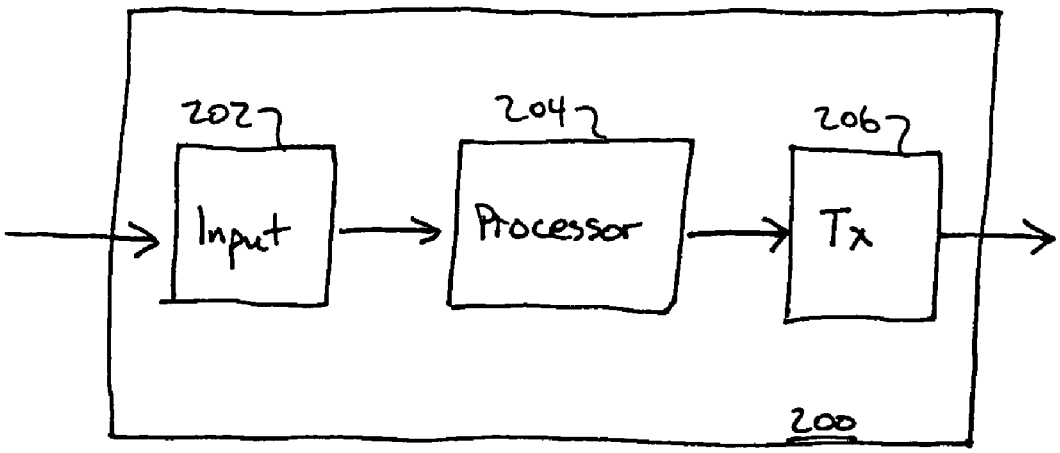
FIG. 11 is a block diagram of a communications device according to an embodiment of the present invention.

FIG. 11 is a block diagram of a communications device 200 implementing an embodiment of the present invention. The communications device 200 includes an input block 202, a processor 204, and a transmitter block 206. The communications device may also include other components such as an output block (e.g., a speaker), a battery or other power source or connection, a receiver block, etc. that need not be discussed in regard to embodiments of the present invention. As an example, the communications device 200 may be a cellular telephone, cordless telephone, or other communications device concerned about spectrum or power efficiency.

The input block 202 receives input signals. As an example, the input block 202 may include a microphone, an analog to digital converter, and other components.

The processor 204 controls voice activity detection as described above with reference to FIG. 1. The processor 204 may also control other functions of the communication device 200. The processor 204 may be a general processor, an application-specific integrated circuit, or a combination thereof. The processor 204 may execute a control program, software or microcode that implements the method described above with reference to FIG. 1. The processor 204 may also interact with other integrated circuit components or processors, either general or application-specific, such as a digital signal processor, a fast Fourier transform processor (see step 102), an infinite impulse response filter processor (see step 106), a memory to store interim and final results of processing, etc.

The transmitter block 206 transmits the signals resulting from the processing controlled by the processor 204. The components of the transmitter block 206 will vary depending upon the needs of the communications device 200.

Although the invention has been described with reference to certain specific embodiments, various modifications thereof will be apparent to those skilled in the art without departing from the spirit and scope of the invention as outlined in the claims appended hereto.

What is claimed is:

1. A method for voice activity detection on an input signal using a log likelihood ratio (LLR), comprising the steps of:

determining and tracking instant, minimum and maximum power levels of the input signal;

selecting a first predefined range of signals of the input signal to be considered as noise signals;

selecting a second predefined range of signals of the input signal to be considered as voice signals;

using the voice signals, noise signals and power levels for calculating the LLR;

using the LLR for determining a threshold; and using the threshold for differentiating between noise and voice in the input signal.

2. The method of claim 1, wherein the instant power level is determined by:

transforming the input signal into a frequency domain input signal;

determining a sum of signal power of a preselected frequency range of the frequency domain input signal; and filtering the sum of signal power.

3. The method of claim 2, wherein the minimum power level is determined by filtering the instant power level to generate a first filtered signal such that the first filtered signal reacts quickly to a decrease in power and slowly to an increase in power.

4. The method of claim 3, wherein the maximum power level is determined by filtering the instant power level to generate a second filtered signal such that the second filtered signal reacts quickly to an increase in power and slowly to a decrease in power.

5. The method of claim 4, wherein the first predefined range of signals comprises all signals within a first power range above the minimum power level.

6. The method of claim 4, wherein the second predefined range of signals comprises all signals within a second power range below the maximum power level.

7. The method of claim 1, wherein the LLR includes a plurality of values, and wherein the threshold is determined by averaging the values of the LLR for the first predefined range of signals.

8. The method of claim 7, wherein the threshold is zero or below.

9. The method of claim 8, wherein the threshold is an average of the values of the LLR plus a predefined margin.

10. An apparatus including a communications device having a voice activity detection processor for controlling spectral efficient or power efficient voice transmissions relating to an input signal, said voice activity detection processor being configured to execute processing including:

determining and tracking instant, minimum and maximum power levels of the input signal;

selecting a first predefined range of signals of the input signal to be considered as noise signals;

selecting a second predefined range of signals of the input signal to be considered as voice signals;

using the voice signals, noise signals and power levels for calculating a log likelihood ratio (LLR);

using the LLR for determining a threshold; and using the threshold for differentiating between noise and voice in the input signal.

* * * * *